engagement, the engagement being such that the link moves pendulously with respect to the transducer in the first vertical plane containing the horizontal axis of the transducer and in the second vertical plane normal to the first vertical plane.

3. The improvement claimed in claim 2 wherein the support means includes a weighbridge and the loading means includes:

a lower link engaging the upper link to apply the vertical load thereto;

a cross pin in the horizontal and with an axis normal to the axis of the transducer, the cross pin engaging the lower link to apply the vertical load thereto, the cross pin and the lower link being engaged to permit pendulous movements of the cross pin with respect to the lower link in the first and second vertical planes;

a girder chair engaging the weighbridge and the cross pin to apply the vertical load to the cross pin; and the vertical load being applied serially to the girder chair, cross pin, lower link, upper link and transducer.

4. The improvement claimed in claim 3 wherein:

the transducer has an upward facing groove normal to the axis thereof with a convex upward curvature;

the upper link has a passage therein with a concave downward upper perimeter nesting in the groove of the transducer;

the cross pin has a downward facing groove normal to the axis thereof with a convex downward curvature; and the lower link has a passage therein with a concave upward lower perimeter nesting in the groove of the cross pin.

5. The improvement claimed in claim 4 wherein the upper and lower links rigidly interconnect.

6. The improvement claimed in claim 5 wherein the groove in the transducer has a concave upward curvature in vertical planes parallel to the axis of the transducer and the upper perimeter of the link is convex downward in these vertical planes.

7. The improvement claimed in claim 6 wherein the groove in the cross pin has a concave downward curvature in vertical planes parallel to the axis of the cross pin and the lower perimeter of the lower link is convex upward in these vertical planes.

8. The improvement claimed in claim 7 wherein the girder chair has depending legs which engage the cross pin and which are generally oriented to one side of the links in the same vertical zone.

9. The improvement claimed in claim 2 wherein the support means includes a weighbridge and the mounts are laterally of the weighbridge, the loading means including:

a lower link engaging the upper link to apply the vertical load thereto;

a cross pin in the horizontal and with an axis normal to the axis of the transducer, the cross pin engaging the lower link to apply the vertical load thereto, the cross pin and the lower being engaged to permit pendulous movements of the cross pin with respect to the lower link in the first and second vertical planes;

means securing the cross pin to the weighbridge for applying the vertical load to the cross pin and with the cross pin extending laterally of the weighbridge; and the vertical load being applied serially and successivley to the securing means, cross pin, lower link, upper link and transducer.

10. The improvement claimed in claim 9 wherein:

the transducer has an upward facing groove normal to the axis thereof with a convex upward curvature;

the upper link has a passage therein with a concave downward upper perimeter nesting in the groove of the transducer;

the cross pin has a downward facing groove normal to the axis thereof with a convex downward curvature; and the lower link has a passage therein with a concave upward lower perimeter nesting in the groove of the cross pin.

11. The improvement claimed in claim 10 wherein the upper and lower links rigidly interconnect.

12. In combination with a heavy duty industrial scale of the type having a weighbridge supported by a plurality of load indicating mounts, and means responsive to signals from all the mounts to indicate the weight of an object, an improvement in each of the mounts which comprises:

a. a shear-loaded transducer horizontally disposed;

b. means for rigidly mounting the ends of the shear-loaded transducer to ground;

c. means for loading the shear-loaded transducer only in shear in a zone intermediate the ends of the transducer are only in a vertical direction;

d. means on each side of the loading zone for producing signals responsive to shear load; and e. means for loading the transducer including means for permitting horizontal movement of the weighbridge in response to horizontal forces by pendulous movements of the loading means with respect to the transducer in a first vertical plane containing the horizontal axis of the transducer and in a second vertical plane normal to the first vertical plane.

13. The improvement claimed in claim 12 wherein the loading means includes:

an upper link engaged with the transducer to apply the vertical load thereto, the engagement providing the pendulous movement of the loading means through pendulous movements of the link with respect to the transducer in the first vertical plane containing the horizontal axis of the transducer and in the second vertical plane normal to the first vertical plane.

14. The improvement claimed in claim 13 wherein the loading means includes:

a lower link engaging the upper link to apply the vertical load thereto;

a cross pin in the horizontal and with an axis normal to the axis of the transducer, the cross pin engaging the lower link to apply the vertical load thereto, the cross pin and the lower link being engaged to permit pendulous movements of the cross pin with respect to the lower link in the first and second vertical planes;

a girder chair engaging the weighbridge and the cross pin to apply the vertical load to the cross pin; and the vertical load being applied serially to the girder chair, cross pin, lower link, upper link and transducer.

15. The improvement claimed in claim 14 wherein:

MEANS FOR CONTROLLING THE SPEED OF A CABLE

SUMMARY OF THE INVENTION

This invention relates to an apparatus for controlling the speed at which a cable is unwound from and would onto a cable drum disposed on a movable vehicle in general and more particularly to an improved apparatus of this nature permitting operation over larger ranges of distance and velocity.

Various vehicles which are electrically driven such as mobile cranes, loading machines in mines and the like have a cable connection to a feeding source and thus include a cable drum onto which cable must be unwound or rewound as the vehicle moves away from or towards the feeding source. When vehicles of this nature are driven at great speed or when they accelerate or decelerate rapidly, great demands are placed on the control system for the cable drum. This is particularly true when the vehicle must have a large range of operating capability. With large distance capabilities great amounts of cables must be wound on the drum. The greater the amount of cable which is wound on the drum, the greater the moment of inertia.

Because of these problems, prior art control devices have not been completely satisfactory for controlling cable drum drives in vehicles of this nature. Thus, the need for an improved cable drum drive system for use in electrically driven vehicles becomes evident.

SUMMARY OF THE INVENTION

The present invention provides an apparatus for controlling the drive of the cable drum and thus controlling the speed at which the cable is wound and unwound reliably under the types of conditions noted above.

In accordance with the present invention this is accomplished by measuring the actual cable drum speed, the speed of the vehicle and the position of a tensioning spring associated with the cable drum drive. The difference between the actual drum speed and the sum of the vehicle speed and tensioning device position is used to develop an error signal which is the input to a proportional integral controller. The controller develops a control output which is used to control means for driving a DC motor having its shaft coupled to the cable drum.

DETAILED DESCRIPTION OF THE INVENTION

Figure 1:
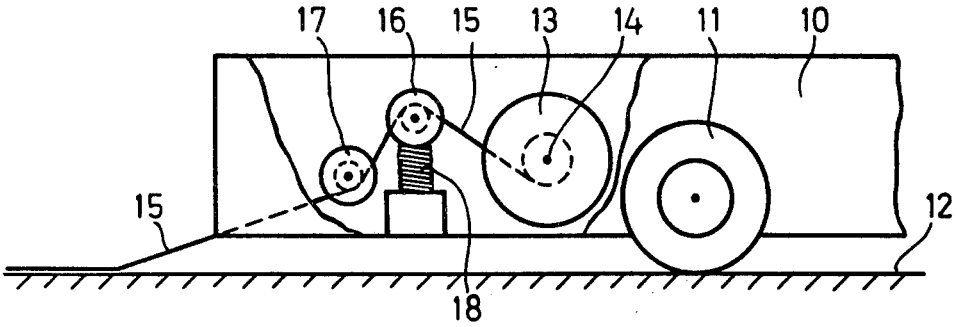
FIG. 1 is a schematic elevation view illustrating cable drum equipment disposed on a movable vehicle.

FIG. 1 illustrates a cable drum system of the type which is controlled by the apparatus of the present invention. Shown is a vehicle 10 movable on wheels 11 which ride on a base 12. Mounted on the vehicle 10 is a cable drum 13 supported for rotation on a shaft 14. The shaft is coupled to a drive unit, not shown on FIG. 1 but to be described below in connection with FIG. 2. A cable 15 is wound onto the drum 13. The cable runs from the drum 14 over traversing wheels 16 and 17, respectively. The shaft of the traversing wheel 16 is mechanically coupled to a spring assembly 18 attached to the vehicle. The spring assembly 18 applies a bias force in an upward direction to the traversing wheel 16. Winding and unwinding of the cable 15 applies a force to the wheel which opposes the spring force. The traversing wheel 17 is fixed to the vehicle 10. Regulation of the cable speed will result in a regulation of the height of the traversing wheel 16 as will be obvious to those skilled in the art.

Figure 2:
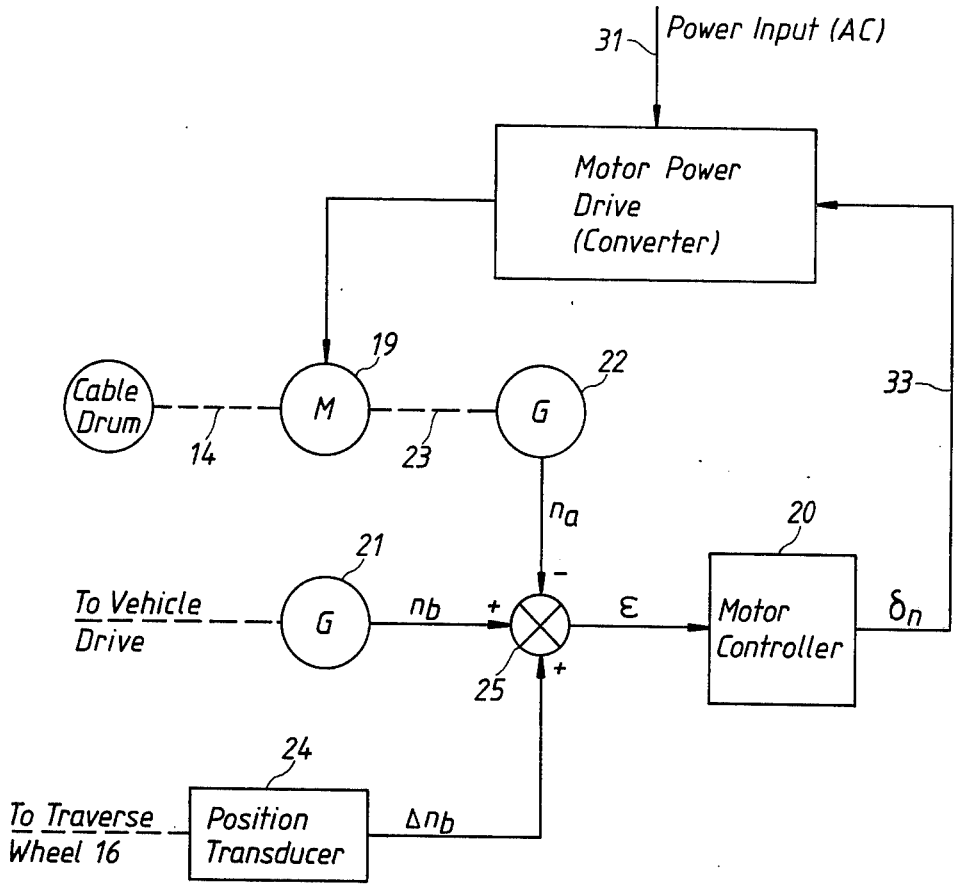
FIG. 2 is a block diagram of the control apparatus of the present invention for controlling the cable speed in the system of FIG. 1.

FIG. 2 is a block diagram illustrating the improved apparatus of the present invention for controlling the cable drive of FIG. 1. As illustrated, the cable drum 13 has its shaft 14 coupled to motor 19 which may be, for example, a separately excited DC motor. The motor is driven from a motor driver 30 which may be a double converter. Control of DC motors using converters is well known in the art. See, for example, Thyristor Phase-Controlled Converters and Cyclo-converters by B. P. Pelly, [John Wiley & Sons, 1971], particularly page 13 et seq. Such control is also disclosed in Harwood's Control of Electric Motors by Ralph A. Miller—master [John Wiley and Sons, 1970]. In the illustrated embodiment there is shown a power input 31 which will be single or 3-phase AC power which in the converter of the motor driver is rectified in a controlled manner in accordance with the control input on line 33, as more fully described in the above-mentioned references.

The control signal on line 33 designated $\delta_n$ is obtained from a motor controller 20. The motor controller 20 is a proportional integral controller obtaining an input error $\epsilon$ from a summing junction 25. The summing junction 25 obtains as a first, actual value, input a quantity $n_a$ from a direction sensitive tachometer generator 22 coupled by means of a shaft 23 to motor 19. The desired value inputs with which the actual value input $n_a$ is summed at the summing junction 25 includes a quantity $n_b$ proportional to vehicle speed and obtained from a second direction sensitive tachometer generator drive system and a quantity $\Delta n_b$ representing the position of the traversing wheel 16 obtained from a position transducer 24. Position transducer 24 may, for example, be a potentiometer coupled to the traversing wheel 16. The position transducer 24 is preferably adjusted so that the quantity $\Delta n_b$ is 0 at a preset level of the traversing wheel shaft 16 which is an intermediate position between the uppermost level of that shaft and a lower level which can be reached through compression of the spring assembly 18. What this means is that the quantity $\Delta n_b$ provides a control input to the motor controller 20 which causes it to regulate the drive of motor 19 and thus the cable drive to cause the traversing wheel 16 to remain in an intermediate position. This in turn allows the spring assembly 18 to place a suitable mechanical tension on the cable 15 while at the same time being able to move in both directions to absorb temporary deviations. Thus, the output of the summing junction 25, $\epsilon$, will contain a contribution representing the difference between actual speed $n_a$ and desired speed $n_b$ [a quantity proportional to vehicle speed] and a contribution representing the deviation of the traversing wheel 16 from its desired position. As noted above, this input signal $\epsilon$ is provided to the motor controller 20 which is a proportional integral controller. For example, it may comprise an integrating amplifier which changes its output in response to input changes in order to develop an output $\delta_n$ which will result in a motor speed at which the error signal $\epsilon$ is zero.

What is claimed is:

1. Apparatus for controlling the speed of a cable when being unwound and wound on a cable drum which is disposed on a movable vehicle said cable drum having associated therewith drive means comprising a. means for measuring the speed of the vehicle and providing a first output signal proportional thereto;

b. means for measuring the speed of rotation of the cable drum and providing a second output signal proportional thereto; and c. control and regulating means having as inputs said first and second signals and providing as an output a third signal which is related to the difference therebetween, said output coupled to control the drive means for said cable drum.

2. Apparatus according to claim 1 and further including a traversing wheel over which said cable runs when going to and from said cable drum said traversing wheel having a shaft which is spring biased and disposed for motion with respect to the vehicle.

3. Apparatus according to claim 2 and further including means for measuring the deviation of said traversing wheel from a preset level providing as an output a fourth signal proportional thereto, said fourth signal being coupled as an additional input to said control and regulating means.

4. Apparatus according to claim 3 wherein said control and regulating means comprise a summing junction having said first, second and fourth signals as inputs and differencing the sum of said first and fourth signals and said second signal to develop a fifth signal.

5. Apparatus according to claim 4 wherein said control and regulating means further include a proportional integral controller having as its input said fifth signal and providing its output as said third signal.

6. Apparatus according to claim 5 wherein said drive means comprises a converter controlled DC motor and wherein said third signal is the control input to the converter of said motor.

7. Apparatus for controlling the speed of a cable when being unwound and wound onto a cable drum which is arranged on a movable vehicle comprising:

a. a DC motor coupled to the cable drum;

b. a converter providing drive inputs to said DC motor;

c. a spring loaded traversing wheel over which the cable runs;

d. means for measuring the vehicle speed and providing a first output signal proportional thereto;

e. means for measuring the speed of rotation of the cable drum and providing a second output signal proportional thereto;

f. means for measuring the deviation of said spring loaded wheel from a predetermined position and providing a third output signal proportional thereto;

g. means for finding the difference between the sum of said first and third signals and said second signal to develop a difference signal; and h. a proportional integral controller having said difference signal as an input and providing its output as a control input to said converter.

* * * * *